United States Patent [19]

Cranberg et al.

[11] 4,360,291

[45] Nov. 23, 1982

[54] SUBSEA FOUNDATION

[76] Inventors: Alexis M. Cranberg, 127 Ash La., Portola Valley, Calif. 94205; Edward D. Dysarz, P.O. Box 20129, Houston, Tex. 77025

[21] Appl. No.: 110,176

[22] Filed: Jan. 7, 1980

[51] Int. Cl.[3] ..... E02D 23/02

[52] U.S. Cl. ..... 405/205

[58] Field of Search ..... 405/203-208, 405/217, 224, 195, 229

[56] References Cited

U.S. PATENT DOCUMENTS

| | | | |
|---|---|---|---|
| 1,716,190 | 6/1929 | Savage | 405/195 |
| 2,551,375 | 5/1951 | Hayward | 405/207 |
| 2,939,290 | 6/1960 | Crake | 405/205 |
| 2,940,266 | 6/1960 | Smith | 405/204 |
| 3,740,956 | 6/1973 | Guy et al. | 405/205 |
| 4,103,502 | 8/1978 | Cashman | 405/195 |
| 4,118,941 | 10/1978 | Bruce et al. | 405/207 |
| 4,154,552 | 5/1979 | Bilderbeek | 405/229 |

*Primary Examiner*—Dennis L. Taylor

*Attorney, Agent, or Firm*—Ned Conley; David Alan Rose; William E. Shull

[57] ABSTRACT

A recoverable or permanent rigid subsea form having retaining walls to contain fill material to stabilize, raise and/or provide a level surface above the sea floor. Portions of the retaining walls comprise hollow tanks that are alternately flooded and emptied to control the buoyancy of selected portions of the form. Alternatively, the retaining walls comprise solid plates. Means are provided in the retaining walls for allowing offshore equipment to pass into and out of the form.

The form is set in place on or below the sea floor and the fill material is placed in the form. The fill material is leveled by gravity or other means to form a level surface at the desired elevation. Drilling and/or production equipment can then be placed on the level subsea surface.

5 Claims, 18 Drawing Figures

SUBSEA FOUNDATION

BACKGROUND OF THE INVENTION

This invention relates generally to offshore drilling and processing facilities, and more particularly to apparatus and methods for making firm and level foundations for said facilities, and for providing support for said facilities above the sea floor to increase their operational water depth capabilities.

In the offshore drilling and/or processing of hydrocarbons or other substances, it is often desired or required that drilling and/or processing equipment be supported on a firm and level subsea foundation. Often, too, such a firm and level subsea foundation must be raised a distance above the level of the natural sea floor in order to allow such equipment to operate in deeper water. Sometimes, the natural seafloor can be leveled, if need be, perparatory to setting a subsea platform foundation upon it as shown, for example, in U.S. Pat. No. 2,940,266, issued June 14, 1960 to Smith. However, such leveling of the sea floor is often difficult or dangerous and is generally time-consuming and expensive, especially for platforms that are moved frequently. Other problems in obtaining a level subsea foundation may arise due to adverse subsea soil conditions at or around the offshore facility location. For example, the sea floor may be rocky or uneven, causing a subsea platform or support resting upon it to tilt or be unstable, or it may be composed of a soft mud that is unable to support the weight of the offshore facility. In addition, the offshore location may be in a mud slide area that will require some method of soil stabilization.

Various approaches have been taken in the past toward providing a firm, stabilized, level or raised foundation for offshore drilling and/or production facilities. One approach is to divide the offshore apparatus into a plurality of sections which are pivotally linked together, the bottom of each section being free to assume inclinations conforming to different areas of the sea floor. See, e.g., U.S. Pat. No. Re. 24,346, issued Aug. 20, 1957, to Dawson. Where the sea floor is soft, caissons may be driven into the mud to provide support and stability. See, e.g., U.S. Pat. No. 4,045,968, issued Sept. 6, 1977, to Gerwick, Jr. However, both types off the above devices are complex and expensive to manufacture, install and maintain.

In some cases, oyster shell or gravel is dropped on the sea floor forming a mound on which to set a drilling and/or production platform. The results are usually poor due to the oyster shell or gravel being washed away with the current, or it may flatten out or collapse into itself. Jack-up devices are also used to jack up an underwater platform, but they are expensive and it is often difficult or impossible to get any bottom pressure on the spuds in certain areas.

There is also an item known as a prefabricated floatable flexible barrier. This barrier is towed out to the drilling site, towed around the wellhead or platform, sunk, secured into place with pilings, filled with sand or other material, and then the drill barge is brought into the barrier and placed on the sand. After the drill barge is brought into place, its doors are closed. See, e.g. U.S. Pat. No. 2,939,290, issued June 7, 1960 to Crake. One of the problems with this system is that it is difficult to tow since it is not in a rigid form. It will move with the wind, waves or current and may not be controllable under tow. Furthermore, when it arrives at the wellhead and is sunk, the current may move it. Also, after it has been sunk, it will be difficult to maneuver around the wellhead because it will either be stuck in the mud or it may drift in the current. Moreover, if the bottom has a slope to it, the flexible barrier will not have any support to hold the additional sand required on the low side. The barrier must be secured with pilings to work at all. Piling is an expensive operation offshore. Pilings are also expensive to remove. Another problem with this barrier is that it cannot transport its load of sand to another location and if the sand is left in an area, it could block a channel or disrupt the environment in some other way. Furthermore, the many hinges and flexible hoses cause problems with breakdowns which in turn can shut down the operation or cause the form to sink while under tow.

Artificial islands have also been used in the past. These islands are designed to be towed out to a location, sunk, filled with sand or other material and then the drilling and production equipment is placed on them. See, e.g., U.S. Pat. No. 3,740,956, issued June 26, 1973 to Guy et al. This type of device is not designed to be sunk completely under water and then put into operation and later recovered because it does not have a sealed top on it that will allow it to be filled with air when it is completely submerged. It is open at the top and it is often open at the bottom. Accordingly, it cannot act as an enclosed tank to hold air. Thus, it would not be possible to recover such a device when it is completely submerged. A structure that is the size of these artificial islands is also too large to be lifted out of the water by a derrick barge.

SUMMARY OF THE INVENTION

The present invention uses a simple but highly effective and economical apparatus and method to stabilize, raise and/or provide a level support surface above the natural surface of the sea floor. The invention can be used to support offshore equipment in waters, for example, between 2 and 100 feet deep, and where the sea floor is uneven or soft or too deep for a particular platform or drill barge. However, it should be realized that the present invention could be applied to, for example, any application where it is desired to support apparatus above the surface of the sea floor in water depth that may vary from a few feet to 150 feet.

The invention includes a recoverable or permanent rigid subsea form having retaining walls for containing fill material such as sand, gravel, oyster shell or other suitable material therewithin. Portions of the retaining walls comprise hollow tanks that are alternately flooded and emptied to control the buoyancy of selected portions of the form. Alternatively, the retaining walls comprise solid plates. Means are provided in the retaining walls for allowing offshore equipment to pass into and out of the form.

The form is set in place on or below the sea floor and the fill material is placed in the form. The fill material is leveled by gravity or other means to form a level surface at the desired elevation. Drilling and/or production equipment such as drill barges, gravity platforms, derrick barges, submersibles, jack-up platforms, subsea drilling and oil production equipment, subsea pipelines or other subsea equipment can then be placed on the level surface.

BRIEF DESCRIPTION OF THE DRAWINGS

For a further understanding of the nature and objects of the present invention, reference should be had to the following detailed description of the preferred embodiments thereof, taken in conjunction with the accompanying drawings, in which like parts are given like reference numerals and wherein.

DETAILED DESCRIPTION OF THE PREFERRED EMBODIMENT OF THE INVENTION

Figure 14:
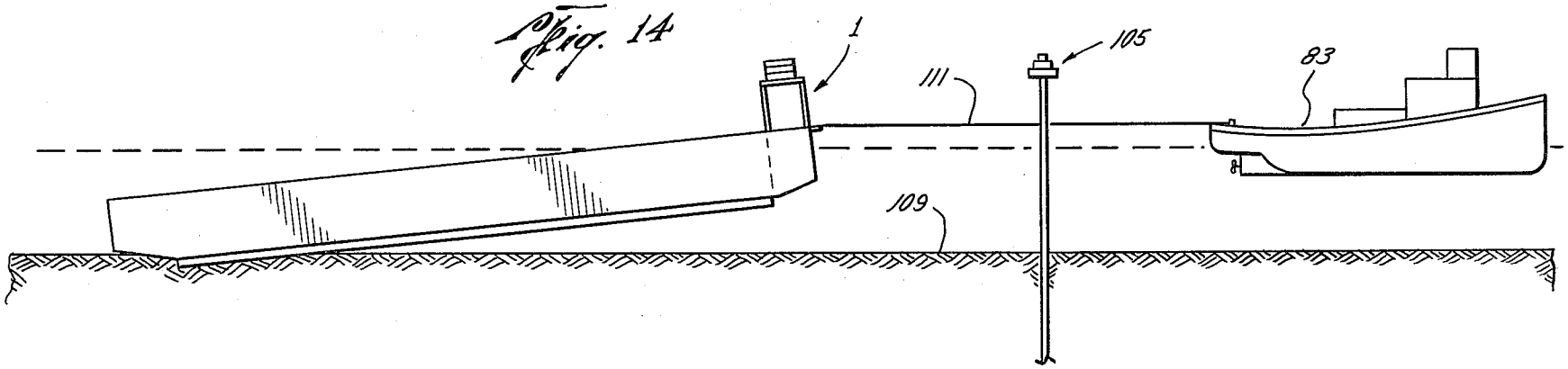
FIG. 14 is a side elevation of the elevating and leveling form of the embodiment of FIG. 1 with the aft end resting on the sea floor and being dragged to an existing wellhead.

Referring to FIGS. 1-8, a first embodiment of the rigid subsea foundation, leveling and elevating device of the invention is shown and includes a form indicated generally as 1. Form 1 is preferably generally rectangular in shape, having elongate sides 3, 5, a bow or front end 7 and a stern or rear end 9. Sides 3, 5 include members that are rectangular in cross-section (FIG. 7) and are hollow, forming a pair of buoyancy tanks 11, 13, respectively, for floating the form 1 when filled sufficiently with, for example, air. Alternatively, tanks 11, 13 may have other cross-sectional shapes, such as round. At the bow 7 of form 1, there are disposed a second pair of hollow buoyancy tanks 15, 17 attached to the inside faces of tanks 11, 13, respectively. Tanks 15, 17 are spaced apart, leaving a passageway 19 therebetween. Tanks 15, 17 are large enough to keep the bow 7 of form 1 afloat when filled sufficiently with, for example, air, even when the side tanks 11, 13 are filled with enough water to cause the stern 9 of form 1 to sink (FIG. 14).

A forward door 21 is vertically slidably disposed on opposing tracks 23, 25 (FIG. 3) mounted on the inside faces of tanks 15, 17 at the rearward portions thereof. Door 21 may be mounted on tracks 23, 25 by any suitable means, e.g. grooves in the side edges of door 21 that receive the inside portions of the tracks, or wheels on door 21 that ride in channels in the tracks. Door 21 can be raised or lowered as shown, for example, by arrows 27 in FIG. 3.

Figure 5:
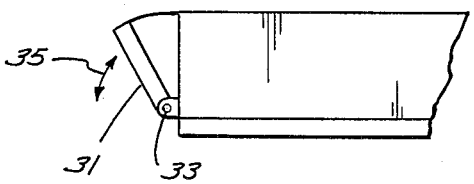
FIG. 5 is a fragmentary side elevation of the apparatus of FIG. 1 showing one type of aft door that can be used for the form.

In the aft end of form 1 near stern 9, there is disposed a rear door 27 that extends between sides 3, 5 of form 1. Rear door 27 may be composed of a plurality of box beams 29 stacked one upon another as shown, for example, in FIGS. 2 and 8, or alternatively, it may comprise a single member 31 attached at its bottom side to form 1 by hinges 33 (FIG. 5). When the latter type of rear door 27 is used, i.e., the hinged door, it may be raised or lowered as shown by arrows 35 in FIG. 5. When the box beam type of rear door is used, box beams may be added or removed to make the rear door 27 higher or lower, respectively. The rear door 27 is lowered, by either removing box beams or lowering the hinged door as the case may be, to allow a drill barge 37 (FIG. 9) or other equipment such as a derrick barge, a jack-up rig, or a submersible drilling rig to be put into or taken out of the form 1. The box beam door can also have box beams added or removed depending on how much draft the drill barge 37 or other equipment will have.

Tanks 11, 13, 15, 17, door 21 and door 27 of form 1 are rigidly connected together such that when the doors are in a closed position, i.e. when door 21 is lowered and when door 27 is raised, the tanks and doors serve as retaining walls for containing fill material such as sand, gravel, oyster shell or other suitable material inside the form.

Figure 1:
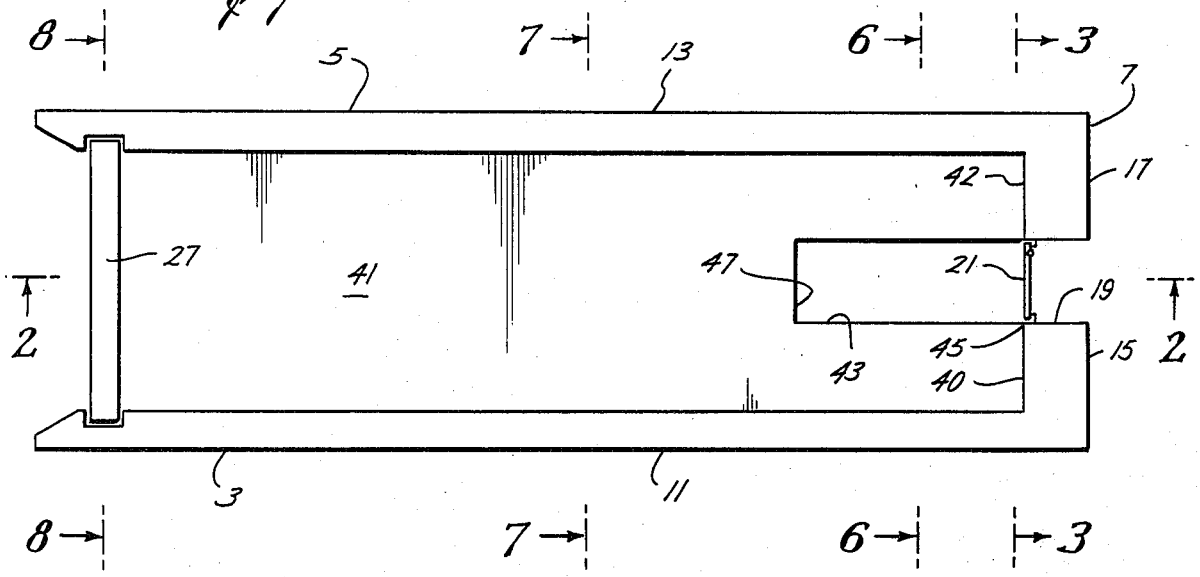
FIG. 1 is a plan view of apparatus incorporating the first embodiment of the recoverable or permanent rigid subsea form of the invention.
Figure 2:
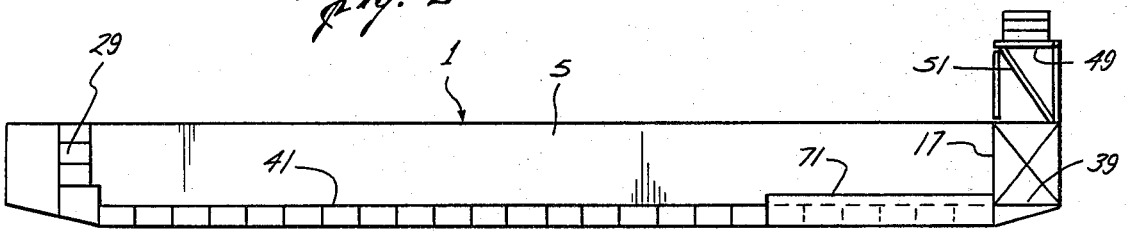
FIG. 2 is a longitudinal sectional view of the apparatus of FIG. 1 taken along lines 2—2 of FIG. 1, showing the forward door.

The bottom of the form 1 includes an outer portion or tank bottom 39 and an inner portion or floor 41. The outer portion or tank bottom 39 forms the bottom surfaces of buoyancy tanks 11, 13 and 15, 17. Inner portion or floor 41 is integral with outer portion or tank bottom 39 and extends from side 3 to side 5 of form 1 along substantially the entire length of form 1 from the aft ends 40, 42 of tanks 15, 17, respectively, to rear door 27. Inner portion 41 assists in containing fill material such as sand that is placed in the form and also strengthens and unifies the structure of form 1. As shown in FIG. 1, inner portion of floor 41 includes a slot 43 in its front end which communicates with passageway 19 between tanks 15, 17. Slot 43 extends completely through inner portion or floor 41 from its juncture 45 with passageway 19 to its blind end 47. Under some conditions of the sea floor or its environment, such as a heavy or firm sand or clay bottom, inner portion or floor 41 may not be required.

Figure 3:
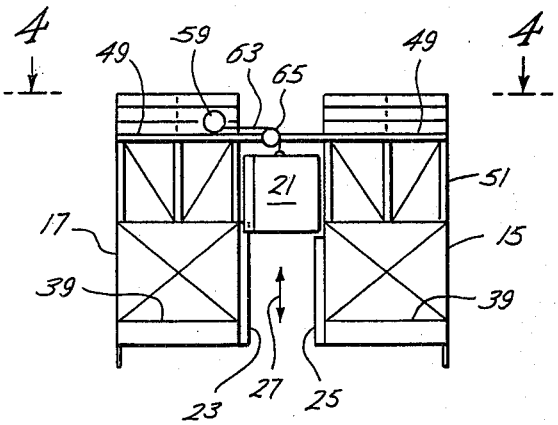
FIG. 3 is a transverse sectional view of the apparatus of FIG. 1 taken through the forward section of the form along lines 3—3.
Figure 4:
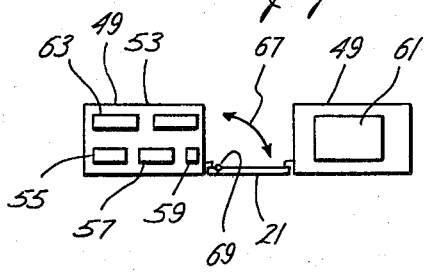
FIG. 4 is a plan view of the machinery deck of the apparatus of FIG. 1 that supports machinery like pumps, generators, and controls.

At the bow 7 of form 1, there is disposed a raised deck 49 supported by legs 51 mounted on top of tanks 15, 17. Raised deck 49 provides a platform for supporting machinery such as a generator 53, pumps 55, control consoles 57, winches 59, storage boxes and may also include enclosed houses 61 or other enclosures such as comfort stations. As shown in FIG. 3, one end of a cable 63 is attached to the top of front door 21. Cable 63 then runs around a sheave 65 and is attached to a winch 59, by means of which the front door 21 can be raised or lowered on tracks 23, 25. When front door 21 is in its raised position, it can be pivoted or swung away as shown by arrows 67 (FIG. 4), the door being supported on a hinge 69 in its raised or open position.

Figure 6:
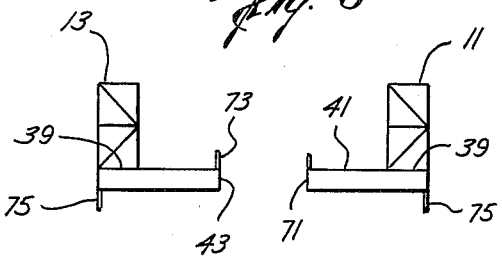
FIG. 6 is a transverse sectional view of the apparatus of FIG. 1 taken through the forward part of the form along lines 6—6.

Referring to FIG. 6, a pair of guard plates 71 are attached to inner bottom portion 41 at the sides of the cut-out region forming slot 43. Plates 71 protrude above the top surface of floor 41 as shown at 73, and extend the length of slot 43. Plates 71 reinforce the floor 41 at slot 43 and serve as bumpers or fenders when the form 1 is placed into position around, for example, an existing wellhead. A skirt 75 of relatively thin cross-section extends downward from the bottoms of the buoyancy tanks around the outer periphery of form 1 along its full length and width. Skirt 75 extends into the mud when form 1 is in place on the ocean floor, to prevent scouring and to prevent the sand or other material inside the form from being washed out of the form.

Figure 7:
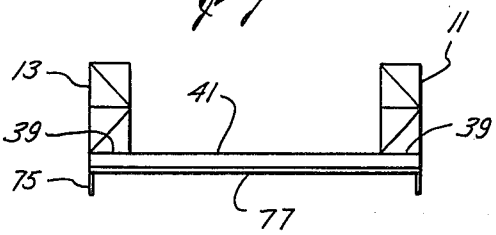
FIG. 7 is a transverse sectional view of the apparatus of FIG. 1 taken through the amidship section of the form along lines 7—7.
Figure 8:
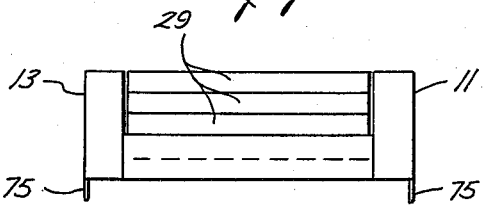
FIG. 8 is a transverse sectional view of the apparatus of FIG. 1 taken along lines 8—8, showing the box beam type door on the aft end of the form.

As shown in FIG. 7, a transverse beam 77 is connected between buoyancy tanks 11, 13 to provide structural support for form 1 and to combine tanks 11, 13 into an integral unit. Beam 77 can be solid, or it can be hollow and in communication with both buoyancy tanks 11, 13 so that they may be operated, i.e. flooded or emptied, as a unit. Beam 77 is preferably located in the amidship section of form 1. If form 1 is sufficiently long, more than one suitably placed beam 77 may be required to obtain the desired structural support and/or tank operating efficiency.

Figure 10:
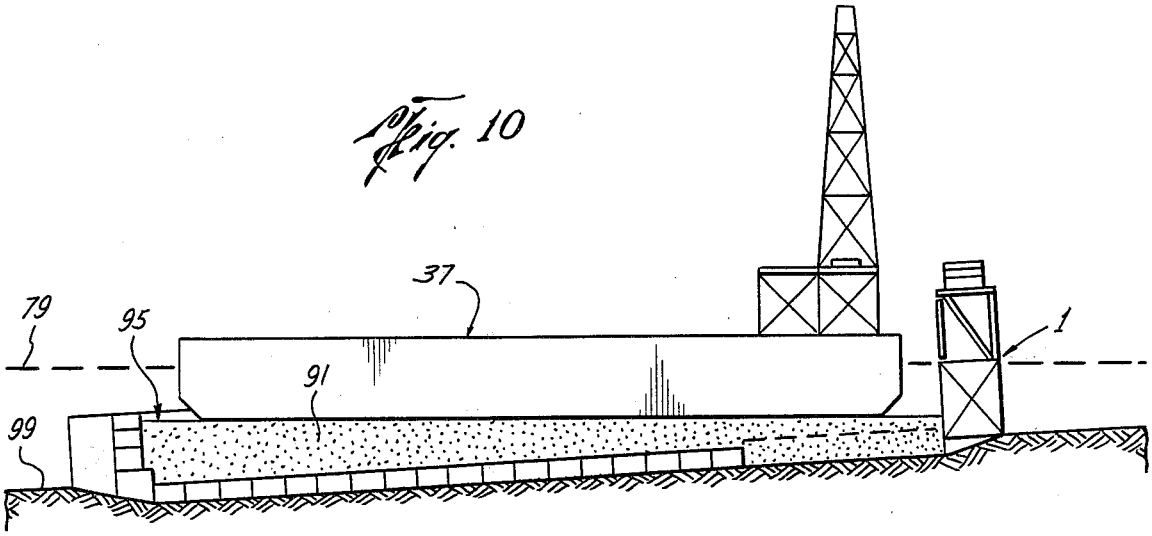
FIG. 10 is a view similar to FIG. 9 showing the elevating and leveling form of the embodiment of FIG. 1 resting on a sloping sea floor with the fill material in the form being level with the surface of the water.
Figure 11:
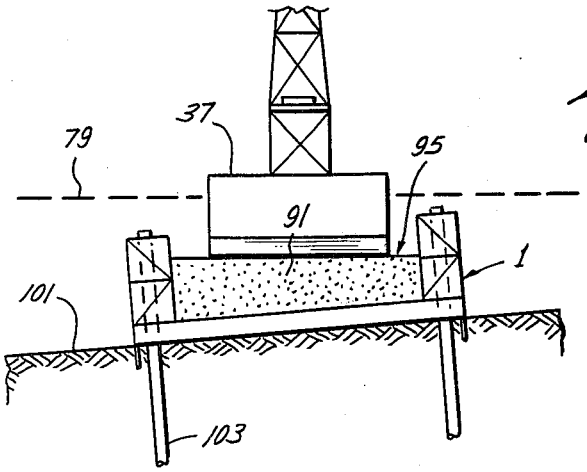
FIG. 11 is an end view partly in elevation and partly in section showing the leveling and elevating form of the embodiment of FIG. 1 sitting on a sea floor sloping in another direction with the fill material contained in the form, forming a level and elevated bottom for a drill barge.
Figure 12:
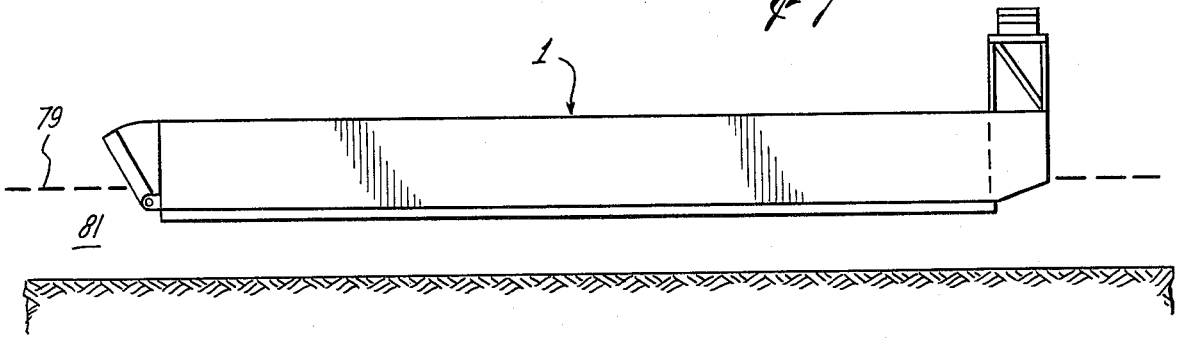
FIG. 12 is a side view which shows the elevating and leveling form of the embodiment of FIG. 1 in a buoyant position ready to be towed or self-propelled to an operations site.
Figure 13:
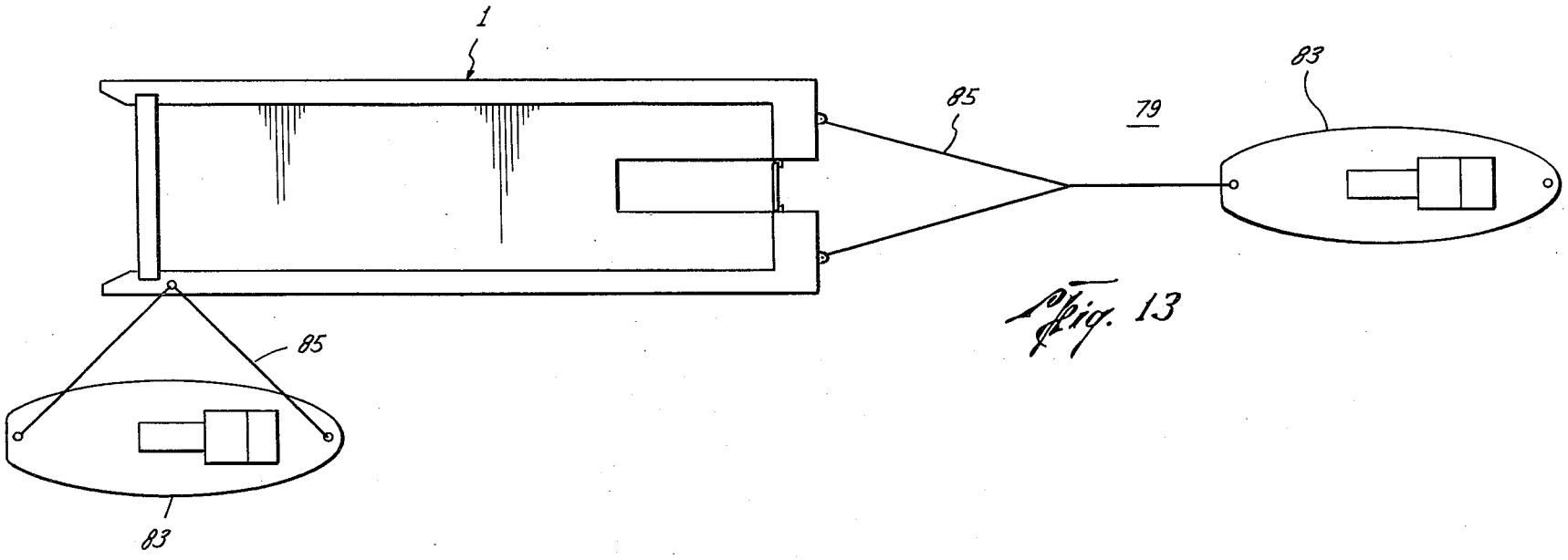
FIG. 13 is a plan view of the elevating and leveling form of the embodiment of FIG. 1 being towed to a site of operations.

Referring to FIGS. 9–16, in using the first embodiment of the rigid subsea foundation, leveling and elevating device of the invention, sufficient air is placed in the buoyancy tanks 11, 13 and 15, 17 to maintain the form 1 in a floating or buoyant position on the surface 79 of the sea 81 (FIG. 12). Form 1 may then be propelled under its own power to its operations location by drive means such as a diesel engine (not shown), or it may be towed to such location by tug boats 83 attached to form 1 by cables 85 (FIG. 13).

Figure 9:
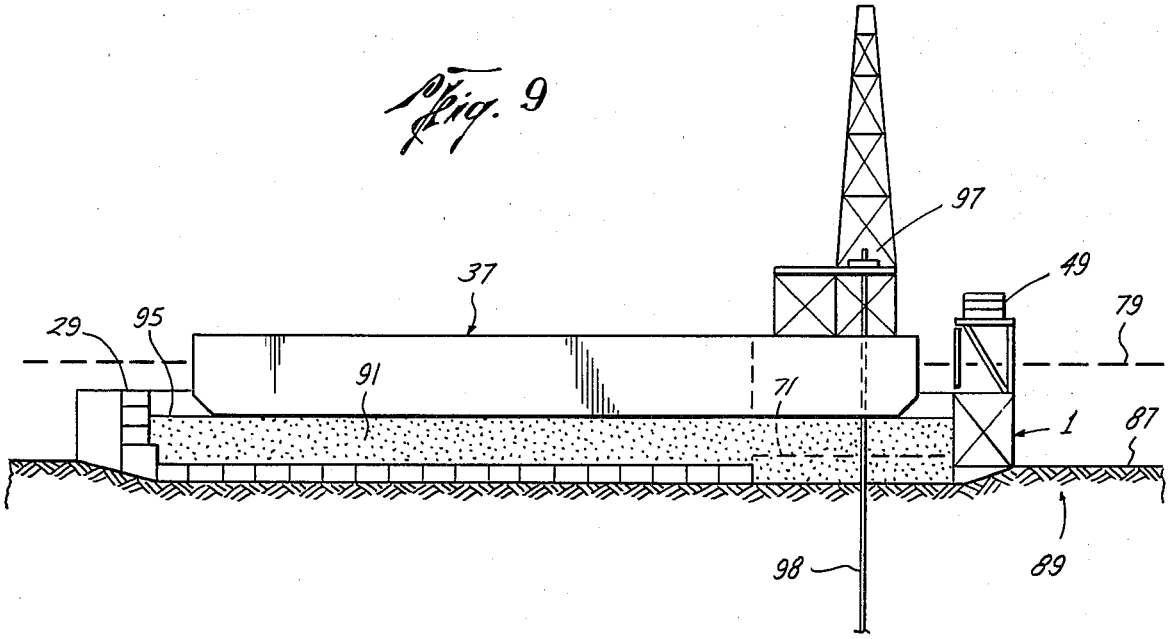
FIG. 9 is a side view partly in elevation and partly in section which shows the form of the embodiment of FIG. 1 holding fill material therewithin, and with a drill barge sitting on top of the fill material contained in the form.

When the form 1 reaches its operations location, sufficient air is removed from tanks 11, 13, 15, 17 and replaced with water such that the form 1 loses its buoyancy and sinks to the sea floor 87 (FIG. 9). Skirt 75 settles into the mud 89 on sea floor 87 as form 1 comes to rest on sea floor 87. With front door 21 in closed, i.e. lowered, position, sand 91 or other suitable material such as gravel or oyster shell is placed into form 1 by a clam shell device 93 (FIG. 16) or other suitable means such as a suction head (not shown), allowing the sand or other suitable material to fall naturally by gravity and form a surface 95 parallel with the surface 79 of the sea 81. When the sand 91 or other suitable material accumulates inside form 1 to a suitable level or elevation, a drill barge 37 or other offshore device is then placed on the level surface 95 of sand 91 making an offshore operation on a level plane possible. Door 29 is lowered, if necessary, to allow the drill barge 37 to enter form 1.

As shown in FIG. 9, drill barge 37 is raised above the surface of the water 79 on the sand 91 contained in form 1 and is drilling a well 97 on a wellhead 98. In this figure, form 1 rests upon an even sea floor 87 while containing sand 91. Form 1 may also be used on an uneven sea floor, as shown in FIGS. 10 and 11. In FIG. 10, form 1 rests upon an uneven sea floor 99. Sand 91 in form 1 has been allowed to fall by gravity and form surface 95 parallel to surface 79 of sea 81. Thus, drill barge 37 resting upon level surface 95 of sand 91 is permitted to perform its offshore operations on a level plane. In FIG. 11, form 1 rests upon an uneven sea floor 101 sloping in another direction. Again the sand 91 or other suitable material is dumped or pumped into form 1 making a surface 95 level to the sea surface 79. The drill barge 37 or other offshore device is then brought into the form 1 and set down on level surface 95 and allowed to perform its normal operation on a level plane. Piles 103 can also be driven into or through form 1 if greater stability is desired or required to secure form 1 to sea floor.

Figure 15:
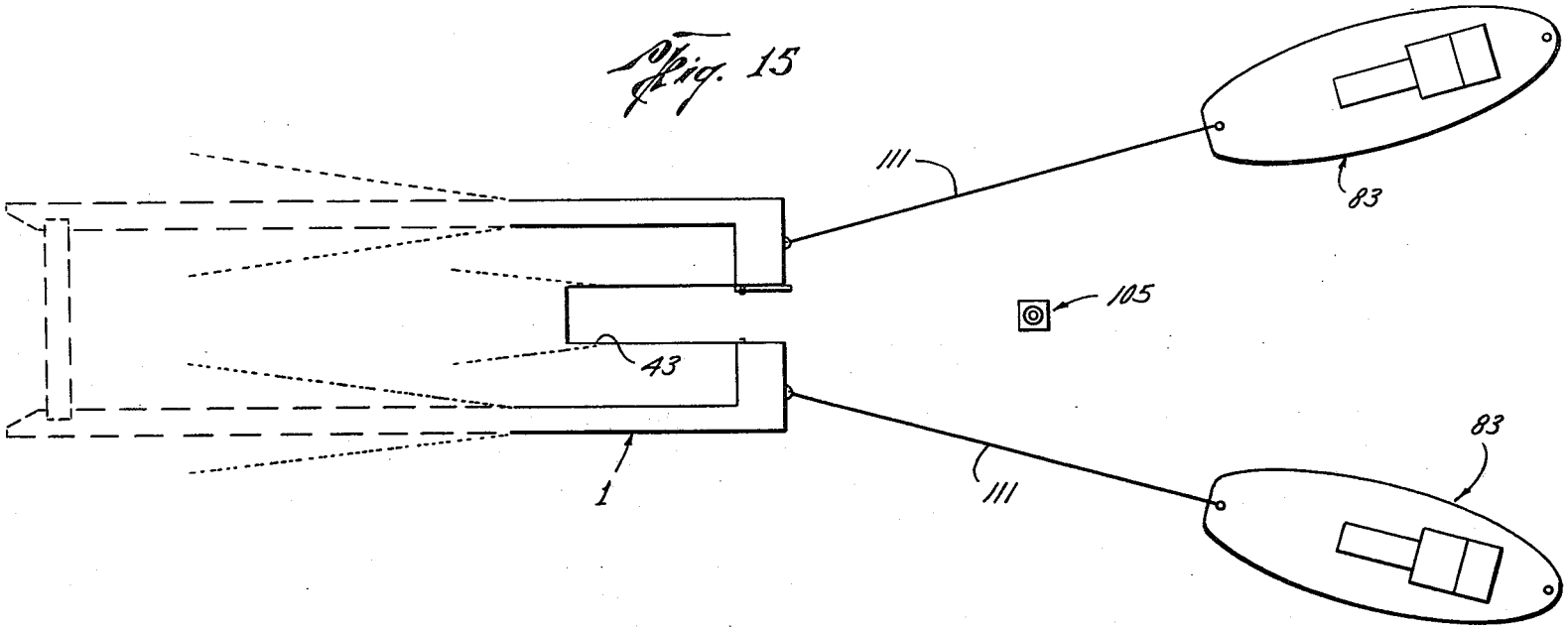
FIG. 15 is a plan view of the operations depicted in FIG. 14.
Figure 16:
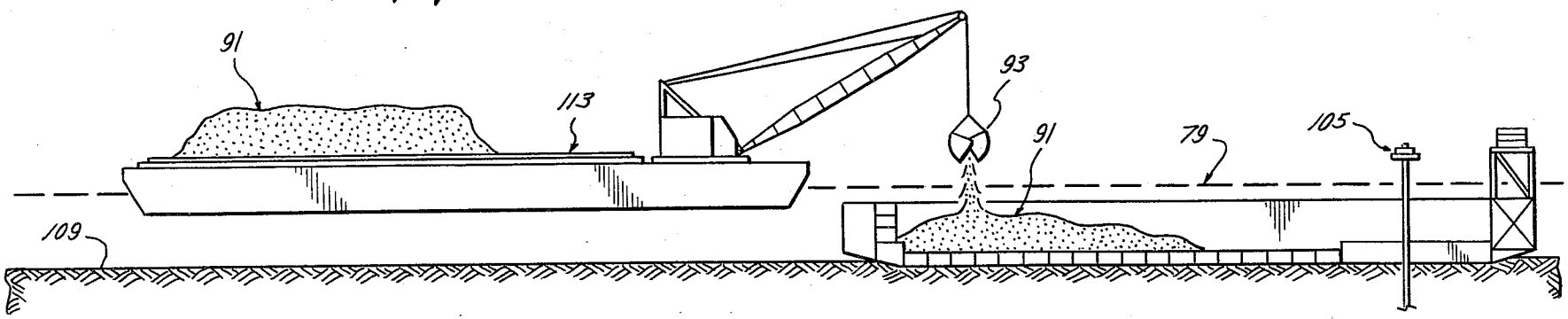
FIG. 16 is a side elevation which shows the form of the embodiment of FIG. 1 resting upon the sea floor with fill material being placed in the form by a clam shell or bucket device from a barge load of the fill material.

Referring to FIGS. 14–16, form 1 may also be used around an existing wellhead 105. When the form 1 has been transported to a position to be pulled to existing wellhead 105, the aft end 107 of form 1 is sunk to the sea floor 109, which may be level or sloping, or smooth or uneven. The door 21 at the front of form 1 is raised and swung away, and form 1 is then dragged to wellhead 105 front-end first by means of a cable 111 or other suitable means that is attached to the tug boats 83 (FIG. 15). Form 1 is dragged to wellhead 105 to hold form 1 on sea floor 109 to keep form 1 from moving with the waves, wind or current and thus to help keep form 1 under control while it is being set into place. Form 1 is dragged to wellhead 105 such that the relative movement between wellhead 105 and form 1 is approximately along the longitudinal axis of form 1 when the operation is viewed in plan (FIG. 15), and such that wellhead 105 is received in slot 43. When form 1 is dragged sufficiently such that wellhead 105 is in the desired position in slot 43, the dragging is stopped, the front tanks 15, 17 are flooded and the front end of form 1 sinks to the sea floor 109. Door 21 is then lowered to enclose wellhead 105 in form 1. As shown in FIG. 16, form 1 is sunk below the surface of the water 79 to the sea floor 109 where it will rest. It is then filled with sand 91 or other suitable material to the desired level or plane by either dumping it with clam shell or bucket 93 from a barge 113 loaded with sand 91 or said other suitable material, or the sand or other material can be pumped into form 1 from a nearby location by a suitable means. To remove the form 1 from around the wellhead 105, the procedure is reversed from FIGS. 12–16. The sand 91 is removed from form 1, the front end of form 1 is raised to the surface 79 by removing water from front tanks 15, 17 and replacing it with air, door 21 is raised and swung away, and the form is pushed or pulled away from wellhead 105. Once form 1 has been removed from around wellhead 105, sufficient air is pumped into tanks 11, 13 to replace the water therewithin and to raise aft end 107 to surface 79. Form 1 is then free to travel to other operations locations if desired.

Figure 17:
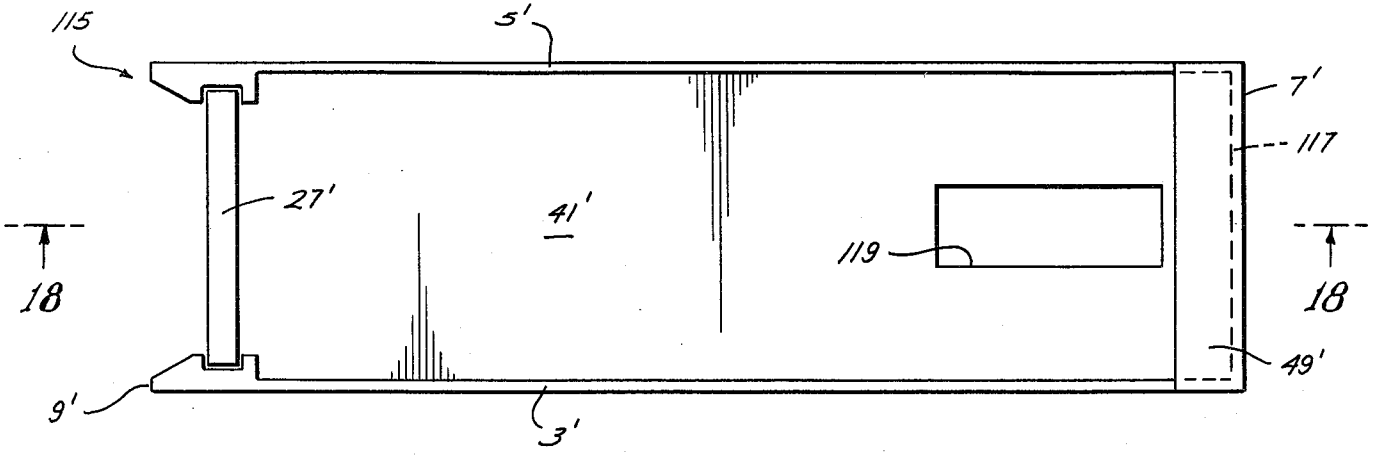
FIG. 17 is a plan view of apparatus incorporating a second embodiment of the recoverable or permanent rigid subsea form of the invention.
Figure 18:
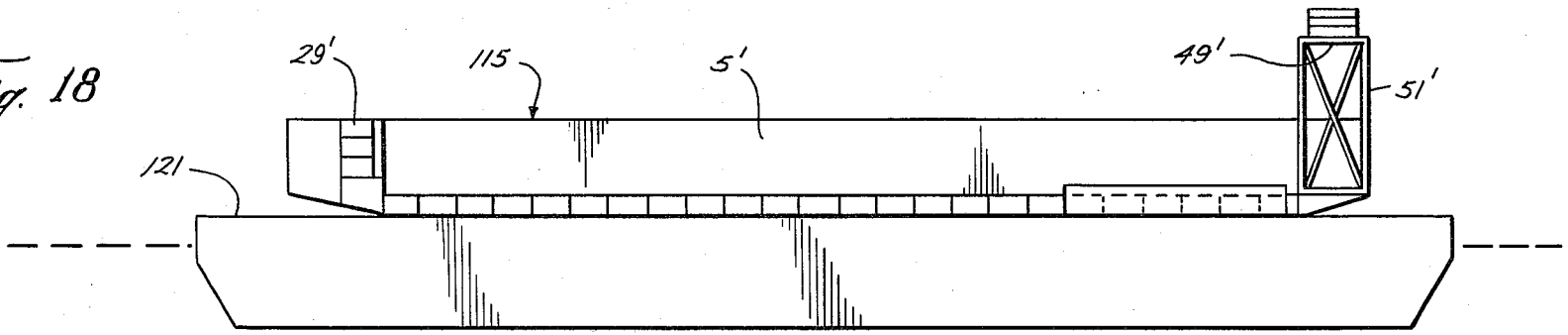
FIG. 18 is a side view partly in elevation and partly in section of the second embodiment of the form of the invention resting on top of a floating barge.

The rigid subsea foundation, leveling and elevating device of the invention can also be non-buoyant and brought out to the operations site on a barge or other suitable means where it can be set into place with a derrick. Referring to FIGS. 17 and 18, a second embodiment of the apparatus of the invention is generally rectangular and includes a form 115 having elongate sides 3', 5', a bow or front end 7' and a stern or rear end 9'. Sides 3', 5' are relatively thin, solid plates made of steel or other suitable material. At the bow 7' of form 115, there is a solid front plate 117 of steel or other suitable material attached to sides 3', 5', as by welding.

In the aft end of form 115 near stern 9', there is disposed a rear door 27' like door 27 of form 1. The bottom of form 115 may include a floor 41' of steel or the like extending substantially the entire width and length of form 115. Depending upon sea bottom conditions, floor 41' may not be required. When floor 41' is used, it preferably has a cut-out region 119 extending through the floor so that the form 115 may be set into place over an existing wellhead. A raised deck 49' is supported on legs 51' at the front of form 115 and, like deck 49, provides a platform for machinery and the like.

In use, form 115 is transported to its operations location on a barge 121 or other suitable means. Form 115 is then lifted from barge 121 by a derrick or crane or other suitable means and lowered into the water, where it sinks into position on the sea floor. Form 115 is then filled with sand or other suitable material in the same manner as the buoyant form 1. When it is desired to remove form 115 from the sea floor, the sand or other material is removed from form 115, and it is then lifted to the surface of the water by a derrick or crane and placed on barge 121 or other suitable means for transport to another location.

In both the embodiments of the invention described above, the structure of the forms 1, 115 is composed of materials such as concrete, wood, steel or other metal so as to give the forms 1, 115 the desired strength and rigidity to withstand the forces of wind, waves or current to which it is subject, and to support the weight of the sand or other material contained inside the forms. Also, sufficient coatings or galvanic anode-type protection is provided to minimize corrosion or deterioration of the forms by the action of the sea water.

The forms 1, 115 of the invention may be modified in various respects. For example, forms 1, 115 may have shapes other than rectangular. Thus, forms 1, 115 may be generally triangular in shape, they may be generally square, or they may be generally round. The above alternative embodiments are merely exemplary of the possible changes or variations that may be made.

Because many varying and different embodiments may be made within the scope of the inventive concept herein taught, and because many modifications may be made in the embodiments herein detailed, it should be understood that the details described herein are to be interpreted as illustrative and not in a limiting sense.

What is claimed as invention is:

1. A form for use on the bottom of a body of water for constructing an underwater foundation for offshore drilling or production equipment, comprising:

a rigid outer structure surrounding a space having a fixed area;

means for containing fill material in such space within said structure when said structure rests on such bottom of such body of water, said structure being sized to rest substantially completely below the surface of the water; and buoyancy means located on said structure for controlling the buoyancy of said structure, the location of said buoyancy means being such that the ends of said structure can be sequentially sunk to and raised from such bottom of such body of water;

said rigid outer structure including means for lowering a section of said structure and for permitting the passage of such offshore equipment over said lowered section and into or out of said form;

first and second sidewall members each having a front end and a rear end;

first and second front wall members rigidly connected to the front ends of said first and second sidewall members, respectively, there being a passageway between said first and second front wall members;

a front door member slidably pivotally connected to said first and second front wall members across said passageway; and a rear door member releasably connected to said first and second sidewall members at the rear ends thereof.

2. A form according to claim 4, said first and second sidewall members and said first and second front wall members including hollow tanks disposed therewithin, said buoyancy means including means for alternately flooding and emptying said tanks for controlling the buoyancy of said sidewall members and said front wall members to effect such sequential sinking and raising of said ends of said structure.

3. A form for use on the bottom of a body of water for constructing an underwater foundation for offshore drilling or production equipment, comprising:

a rigid outer structure surrounding a space having a fixed area; means for containing fill material in such space within said structure when said structure rests on such bottom of such body of water, said structure being sized to rest substantially completely below the surface of the water; and buoyancy means located on said structure for controlling the buoyancy of said structure, said rigid outer structure including means for lowering a section of said structure and for permitting the passage of such offshore equipment over said section and into or out of said form, first and second sidewall members each having a front end and a rear end, first and second front wall members rigidly connected to the front ends of said first and second sidewall members, respectively, there being a passageway between said first and second front wall members, a front door member slidably pivotally connected to said first and second front wall members across said passageway, a rear door member forming said section of said structure releasably connected to said first and second sidewall members at the rear ends thereof, a bottom member connected to said sidewall members and said front wall members, said bottom member having a slot therein in communication with said passageway between said front wall members, said first and second sidewall members and said first and second front wall members including hollow tanks disposed therewithin, said buoyancy means including means for alternately flooding and emptying said tanks for controlling the buoyancy of said sidewall members and said front wall members.

4. A form according to claim 4, further including a downwardly extending skirt connected to the bottom of said rigid outer structure around the perimeter thereof.

5. A method for constructing an underwater foundation on the bottom of a body of water around an offshore wellhead, comprising the steps of:

floating a buoyant rigid form having a door on its front end to a position near the wellhead;

decreasing the buoyancy of and sinking the rear end of said form to such bottom of such body of water;

opening said door;

moving said form toward said wellhead front-end-first until said form surrounds such wellhead, such wellhead passing through said door;

closing said door;

decreasing the buoyancy of and sinking said front end of said form to such bottom of such body of water; and filling the form with fill material to a desired elevation.

* * * * *

UNITED STATES PATENT AND TRADEMARK OFFICE

CERTIFICATE OF CORRECTION

PATENT NO. : 4,360,291

DATED : November 23, 1982

INVENTOR(S) : Alexis M. Cranberg; Edward D. Dysarz

It is certified that error appears in the above—identified patent and that said Letters Patent is hereby corrected as shown below:

Column 5, line 6; delete "of" and insert --or--.

Column 8, line 31; in claim 2, after "claim" delete "4" and insert --1--.

Column 9, line 9; in claim 4, after "claim" delete "4" and insert --1--.

Signed and Sealed this

Third Day of May 1983

[SEAL]

*Attest:*

GERALD J. MOSSINGHOFF

*Attesting Officer*

*Commissioner of Patents and Trademarks*